US007090599B2

(12) United States Patent
Hedgepath

(10) Patent No.: US 7,090,599 B2
(45) Date of Patent: Aug. 15, 2006

(54) BASEBALL BATTING STANCE TRAINING ASSEMBLY

(76) Inventor: Phillip A. Hedgepath, 937 Pearson St., Cary, IL (US) 60013

( * ) Notice: Subject to any disclaimer, the term of this patent is extended or adjusted under 35 U.S.C. 154(b) by 0 days.

(21) Appl. No.: 10/746,746

(22) Filed: Dec. 24, 2003

(65) Prior Publication Data

US 2005/0143200 A1 Jun. 30, 2005

(51) Int. Cl.
*A63B 69/00* (2006.01)

(52) U.S. Cl. ..... 473/452; 473/417

(58) Field of Classification Search ..... 473/452, 473/422, 218, 225, 450, 458, 464, 417, 415
See application file for complete search history.

(56) References Cited

U.S. PATENT DOCUMENTS

| | | | |
|---|---|---|---|
| 3,342,487 | A | 9/1967 | David |
| 3,350,096 | A | 10/1967 | Kile et al. |
| 3,372,930 | A | 3/1968 | Sertich |
| 3,466,040 | A | 9/1969 | Sertich |
| 3,815,906 | A | 6/1974 | Hermo |
| 3,870,317 | A | 3/1975 | Wilson |
| 3,979,116 | A | 9/1976 | Matchick |
| 4,194,735 | A | 3/1980 | Wilson |
| 4,463,950 | A | 8/1984 | Elkia |
| 4,516,772 | A | 5/1985 | Stratton |
| 4,932,656 | A | 6/1990 | Pierce |
| 5,037,094 | A | 8/1991 | Johnson |
| 5,076,580 | A | 12/1991 | Lang |
| 5,318,290 | A | 6/1994 | Sawyer |
| 5,330,176 | A | 7/1994 | Cagney, Jr. |
| 5,385,343 | A | 1/1995 | Davis, Sr. |
| 5,470,055 | A | 11/1995 | Ritchie |
| 5,613,677 | A | 3/1997 | Walker, Jr. |
| 5,642,880 | A | 7/1997 | Wiseman et al. |
| 5,830,079 | A | 11/1998 | Hudson |
| 5,947,833 | A | 9/1999 | Alward |
| 6,102,818 | A | 8/2000 | Hamilton |
| 6,386,996 | B1 | 5/2002 | Foster |
| 6,432,001 | B1 | 8/2002 | Pierce |
| 2002/0091020 | A1 | 7/2002 | Pierce |
| 2003/0130072 | A1 | 7/2003 | Barth et al. |
| 2005/0003908 | A1 * | 1/2005 | Smull et al. ..... 473/419 |

* cited by examiner

*Primary Examiner*—Mitra Aryanpour
(74) *Attorney, Agent, or Firm*—Meroni & Meroni, P.C.; Charles F. Meroni, Jr.; Christopher J. Scott

(57) ABSTRACT

The present invention provides a baseball batting stance training assembly. The assembly essentially comprises a stance training mat for placement upon a baseball field or similar other playing field and at least one rearward foot-receiving cuff for removable or breakaway attachment to the stance training mat. The stance training mat essentially comprises at least three distinct zones, namely, left and right mat zones and a home plate zone. The left mat zone and the right mat zone are aligned laterally opposite the home plate zone, which home plate zone comprises a home plate marker or virtual home plate. The left and right mat zones each comprise a plurality of foot print indicia. The cuff is removably attached adjacent select rearward foot print indicia and is designed for breakaway from the stance training mat in the event of a net cuff-removing force.

33 Claims, 8 Drawing Sheets

BASEBALL BATTING STANCE TRAINING ASSEMBLY

BACKGROUND OF THE INVENTION

1. Field of the Invention

The present invention generally relates to a training device for improving a baseball player's skills. More particularly, the present invention relates to a training mat for improving a baseball player's batting stance while positioned within a so-called, "batter's box." The present invention thus provides users with means to improve upon a baseball player's batting skills by developing proper batting stance technique.

2. Description of the Prior Art

The key to being successful as an offensive baseball player is the ability to successfully hit or make proper contact with pitched or positioned baseballs. The ability to successfully hit a baseball begins with proper balance at home plate and thus it is critical that baseball players learn the basic batting stance. Once the basic batting stance is mastered, the baseball player typically improves upon the basic batting stance in a manner unique to the player as he or she gains batting experience. It is thus noted that there are many stances from which to choose, but the consensus from most hitting coaches is that the basic parallel stance will provide a novice hitter with the best opportunity to hit the ball.

Typically, the baseball player or hitter should take a parallel stance with the feet shoulder width apart in the middle of the appropriate batter's box adjacent home plate. The hitter should not position himself too close to the plate but close enough so that the head of the bat is able to cover the outside corner. The hitter's weight should be on the balls of his or her feet. As a hitter starts a swing, the hitter typically shifts the hitter's weight to the hitter's back leg turning the hitter's hips rearward. During the swinging action, the hitter typically transfers the hitter's center of gravity in a forward direction, shifting the hitter's weight to the hitter's front or forward leg. As the hitter transfers the hitter's weight, the hitter twists the hitter's hips, torso, and knees while also swinging the bat. It is noted that the described hip action is often considered to be the most important factor, since a significant amount of hitting power will come from the hitter's hips. In order to properly twist a hitter's hips, the hitter should rotate the balls of the hitter's feet. Thus, as the hitter sees the ball approaching him, he shifts the weight from his back leg to his front leg as he "steps into the pitch." He then twists his body, transferring considerable energy to the bat. The hand and the bat initially travel at about 40 mph, but at the point when the bat meets the ball, the hand and the bat will travel in excess of 70 mph. Since the bat is swung at such a high speed, it has been calculated that even 0.01 seconds may make a difference between a home run and a pop out.

It is further noted that parents and coaches are often involved in the process of teaching younger players how to best practice various baseball skills, including batting stance technique. It is also noted, however, that younger baseball players often practice unsupervised. Thus, in an effort to provide players with a means to develop proper batting stance technique, whether supervised or unsupervised, a number of inventors have developed training aids or devices to assist the novice hitter in developing proper batting technique as well as to assist the novice hitter in developing proper batting stance technique. It is thus noted that a variety of different types of batting stance training devices have been developed as a means to aid baseball players in the development of a proper batting stance. Some of the more pertinent prior art relating to batting stance training devices and the like is described hereinafter.

U.S. Pat. No. 3,342,487 ('487 Patent), which issued to David, discloses a Baseball Stance and Stride Practice Plate. The '487 Patent teaches baseball batting stance and stride practice plate comprising a flat plate with raised ridges forming batter foot guides. One ridge is disposed along the width of the plate and the batter's back foot is disposed against this ridge which is provided with an opening to allow the back foot to swivel during the stride. Two other ridges are disposed across the full width of the plate in laterally spaced apart diagonal direction against which the forward foot of the batter is disposed both before and after he takes his batting stride.

U.S. Pat. No. 3,350,096 ('096 Patent), which issued to Kile et al., discloses a Batter's Front Foot Guide. The '096 Patent teaches a guide for restricting movement of a batter's foot relative to a batter's box during batting practice comprising track means extending longitudinally of the batter's box, a movable foot piece, means for attaching one of the batter's feet to the foot piece, and resilient connecting means interposed between the foot piece and the track means.

U.S. Pat. No. 3,372,930 ('930 Patent), which issued to Sertich, discloses a Foot Trainer with Adjustable Rotation and Friction Means. The '930 Patent teaches a trainer for sportsmen which is designed to restrict, while guiding, the rotational movement of one of the sportsman's feet. By varying the degree of rotation of the foot and varying the force required to rotate the foot, the trainer adjustably controls the foot of the sportsman during the movement of his body as in striking a golf ball or tennis ball or baseball.

U.S. Pat. No. 3,979,116 ('116 Patent), which issued to Matchick, discloses a Stride-Box. The Patent teaches a batter's training device comprising a sheet material which defines a first pivot foot opening and a second stride foot opening. Means are provided in the stride foot opening for adjusting the distance of the stride foot opening from the pivot foot opening and for adjusting the length of the stride foot opening.

U.S. Pat. No. 5,076,580 ('580 Patent), which issued to Lang, discloses a Foot Position Teaching Apparatus for Batting Practice. The '580 Patent teaches a foot positioning apparatus, which is flat, flexible, and easy for anyone to use. A first member and a second member are telescopically attached to each other and the first member is pivotally attached to home plate. A third member is pivotally attached to the second member and the second member has foot alignment devices on each end thereof which are pivotally attached to the third member whereby the entire device can be adjustably pivoted around home plate to accommodate both a left hand and a right hand batter and the batter can be adjusted additionally as to foot and leg positions and distance from home plate.

U.S. Pat. No. 5,536,004 ('004 Patent), which issued to Wiseman et al., discloses a Batting Training Device. The '004 Patent teaches a mat marked with first indicia designating home plate and a plurality of second indicia showing sequential segments for the batter to place his or her feet. The Mt may be used alone to achieve a proper batting stance and proper foot positioning in relation to home plate or with at least one measuring means for measuring a point located in the strike zone of the batter identifying the height of a level swing of the bat. This measured specific distance correlates to a proper distance from home plate the batter should distance himself or herself to hit the ball with the "power zone" of the bat with a full arm extension of the leading arm. See also U.S. Pat. No. 5,642,880 ('880 Patent), which also issued to Wiseman et al.

U.S. Pat. No. 6,432,001 ('001 Patent), which issued to Pierce, discloses a Foot Position Trainer Apparatus. The '001 Patent teaches a foot positioning training apparatus comprising a foot support member formed in the shape of the sole of a shoe. A toe portion is attached to a front edge of the support member and extends upwardly and rearwardly therefrom and defines a space for receiving the toes of a batter's foot and, more particularly, for receiving the toe portion of a batter's shoe. The toe portion restricts vertical movement of a batter's foot when batting a baseball. The apparatus further includes an upstanding wall extending along an outer edge of the support surface between the toe portion and a rear edge for restricting outward lateral movement of a batter's foot when batting a baseball. See also U.S. patent application No. 2002/0091020, published by Pierce.

U.S. Patent Application Publication No. 2003/0130072, authored by Barth et al., discloses a Baseball Batting Stride Device and System, and Method of Using Same. This publication teaches an apparatus for modifying the stride of a baseball batter's swing motion, including means of capturing a lower portion of a baseball batter's foot and means of elastomerically tethering the capturing means to substratum, wherein the batter's leading toes are allowed to stride in any direction essentially free of substantial distal destabilizing hindrance.

From a review of these publications and other prior art generally known in the relevant art, it will be seen that the prior art does not teach a baseball batting stance training system or a baseball batting stance training assembly for use in combination with the home plate region of a baseball field, wherein the baseball batting stance system comprises, in combination, a baseball field, a substantially planar stance training mat for placement upon the home plate region of the baseball field, and at least one rearward foot-receiving cuff for removable or breakaway attachment to the stance training mat. It will be further seen that the prior art patents do not teach a stance training mat that is substantially rectangular and planar in design and constructed from a compliant, low memory material that comprises a superior mat surface, an inferior mat surface, and at least three distinct zones. In this last regard, it will be seen that the prior art does not teach a stance training mat comprising three distinct zones defined by a left mat zone, a right mat zone, and a home plate zone wherein the home plate zone comprises home plate marker means or a virtual home plate and the left and right mat zones each comprise foot print indicia.

Still further it will be seen that the prior art does not teach foot print indicia wherein the same are defined by forward foot markers and rearward foot markers, the rearward foot markers comprising structure for receiving a breakaway foot-receiving cuff. The prior art also does not teach a foot-receiving cuff that is designed to properly position the rearward foot, but which cuff may be detached from the stance training mat in a breakaway manner given a sufficient cuff-removing force so as to prevent unfortunate injury to the user.

The prior art thus perceives a need for a baseball batting stance system comprising, in combination, a baseball field, a substantially planar stance training mat for placement upon the home plate region of the baseball field, and at least one rearward foot-receiving cuff for removable or breakaway attachment to the stance training mat. Further, the prior art perceives a need for a stance training mat that is substantially rectangular and planar in design and constructed from a compliant, low memory material comprising a superior mat surface, an inferior mat surface, and at least three distinct zones. In this last regard, it will be seen that the prior art perceives a need for a stance training mat comprising three distinct zones defined by a left mat zone, a right mat zone, and a home plate zone so that users thereof may selectively learn or develop proper batting stance technique on either side of a home plate zone.

Further, the prior art perceives a need for left and right mat zones aligned laterally opposite a home plate zone wherein the left and right mat zones each comprise foot print indicia defined by forward foot markers and rearward foot markers. The prior art perceives a further need for rearward foot markers that comprise structure for receiving a breakaway foot-receiving cuff. The prior art thus further perceives a need for a foot-receiving cuff designed to properly position the rearward foot, while providing breakaway attachment means for detaching the cuff from the stance raining mat in a breakaway manner given sufficient cuff-removing forces so as to prevent unfortunate injury to the user.

SUMMARY OF THE INVENTION

Accordingly, it is an object of the present invention to provide a baseball batting stance system or a baseball batting stance training assembly for use in combination with a baseball playing field, the baseball batting stance system comprising, in combination, a baseball field, a substantially planar stance training mat for placement upon the home plate region of the baseball field, and at least one rearward foot-receiving cuff for removable or breakaway attachment to the stance training mat. It is a further object of the present invention to provide a stance training mat that is substantially rectangular and planar in design and constructed from a compliant, low memory material comprising a superior mat surface, an inferior mat surface, and at least three distinct zones. In this last regard, it is a further object of the present invention to provide a stance training mat comprising three distinct zones defined by a left mat zone, a right mat zone, and a home plate zone, which zones collectively enable users thereof to selectively learn or develop proper batting stance technique on either side of the home plate zone.

Further, it is an object of the present invention to provide left and right mat zones aligned laterally opposite a home plate zone wherein the left and right mat zones each comprise foot print indicia defined by forward foot markers and rearward foot markers. In this regard, it is an object of the present invention to provide rearward foot markers that comprise structure for receiving a breakaway foot-receiving cuff. It is thus a further object of the present invention to provide a foot-receiving cuff designed to properly position the rearward foot, while providing breakaway attachment means for detaching the cuff from the stance training mat in a breakaway manner so as to prevent unfortunate injury to the user should sufficient cuff-removing forces be present during a batting swing.

To achieve these and other readily apparent objectives, the present invention provides a baseball batting stance training system or a baseball batting stance training assembly for use in combination with the home plate region of a baseball field. The baseball batting stance training system or assembly is primarily designed so as to enable users thereof to improve upon the user's batting stance, thus leading to improvement of the user's hitting skills.

It is thus contemplated that the baseball batting stance training system generally comprises a substantially planar stance training mat for placement upon a baseball field or similar other playing field and at least one rearward foot-receiving cuff for removable or breakaway attachment to the stance training mat. The stance training mat is substantially rectangular and planar in design and is constructed from a compliant, low memory material. It is further contemplated that stance training mat may be formed from a substantially transparent material so as to enable users to effectively align the stance training mat upon the home plate region of a baseball or similar other playing field.

The stance training mat essentially comprises a superior mat surface, an inferior mat surface, and at least three distinct zones. The inferior mat surface comprises anti-skid means or slip-resistant means to increase the effective coefficient of friction between engaging surfaces, namely, the inferior mat surface and the home plate region surface. The three distinct zones comprise a left mat zone, a right mat zone, and a home plate zone. The left mat zone and the right mat zone are aligned laterally opposite the home plate zone, which home plate zone comprises home plate marker means or a virtual home plate. The home plate marker means essentially comprises a forward marker edge and a marker apex and is primarily designed for placement upon or superimposed placement with a home plate such that marker apex substantially coincides with the plate apex and the forward marker edge substantially coincides with a forward home plate edge. By placing the stance training mat upon home plate region such that the home plate marker means and the home plate are substantially concentric, the stance training mat becomes properly positioned upon the baseball field to enable users to properly align themselves for pitched or positioned baseballs.

The superior mat surface may comprise indicia means that are primarily designed to visually outline at least two of the described zones. It is contemplated that by outlining at least two of the described zones, the user may more easily properly position himself upon the stance training mat. It is further contemplated, however, that the indicia means may also function to visually outline the home plate marker means so as to enable the users or other players or umpires to more readily perceive the home plate marker means.

The left mat zone and the right mat zone each preferably comprise a plurality of foot print indicia and cuff-engaging means. The foot print indicia also comprise anti-skid or slip-resistant means so as to further improve the safety features of the stance training mat. The foot print indicia comprise forward foot markers and rearward foot markers. Since it has been noted that a basic parallel batting stance enables novice hitters to develop proper stance technique, both the forward foot markers and the rearward foot markers have a longitudinal axis, each longitudinal axis being substantially parallel with the forward marker edge of the home plate marker means.

The cuff-engaging means are located adjacent each rearward foot marker. Since the foot-receiving cuff is designed to be removably attachable to the stance training mat, the foot-receiving cuff essentially comprises superior foot-positioning means and inferior mat-engaging means, the mat-engaging means for breakaway or removable attachment to the cuff-engaging means. The foot-positioning means and the mat-engaging means are preferably constructed from superior grade, flexible, high memory rubber or similar other material which may be flexed to enable receipt of rearward foot and for removable attachment or breakaway attachment to the stance training mat.

The mat-engaging means are capable of providing downwardly-acting, cuff-retaining forces having a downward magnitude and the cuff-engaging means are capable of providing upwardly acting, cuff-removing forces having an upward magnitude. The baseball training system or assembly thus enables a user to place a forward foot upon a forward foot marker and rearward foot upon a rearward foot marker inside foot-receiving cuff. The rearward foot is capable of creating the upwardly acting, cuff-removing forces and the downwardly acting, cuff-retaining forces. The mat-engaging means thus enable the foot-receiving cuff to breakaway from the stance training mat should the upwardly acting, cuff-removing forces exceed the downwardly acting cuff-retaining forces.

It will thus be seen that the engaged forward foot marker, the engaged rearward foot marker, and the foot-receiving cuff function to properly align a user's feet thereby improving the baseball player's or user's batting stance. By properly aligning the player's feet in a basic parallel stance, it is believed that the novice hitter will develop proper stance technique. Further, when a downward force is placed upon the stance training mat such as when a player stands or takes a basic parallel stance upon the stance training mat, the anti-skid means function to keep engaging surfaces in a high friction state thus decreasing skid or slip tendencies as the user stands atop the stance training mat.

Other objects of the present invention, as well as particular features, elements, and advantages thereof, will be elucidated or become apparent from, the following description and the accompanying drawing figures.

BRIEF DESCRIPTION OF THE DRAWINGS

Other features of my invention will become more evident from a consideration of the following brief description of patent drawings, as follows.

DETAILED DESCRIPTION OF THE PREFERRED EMBODIMENT

Figure 1:
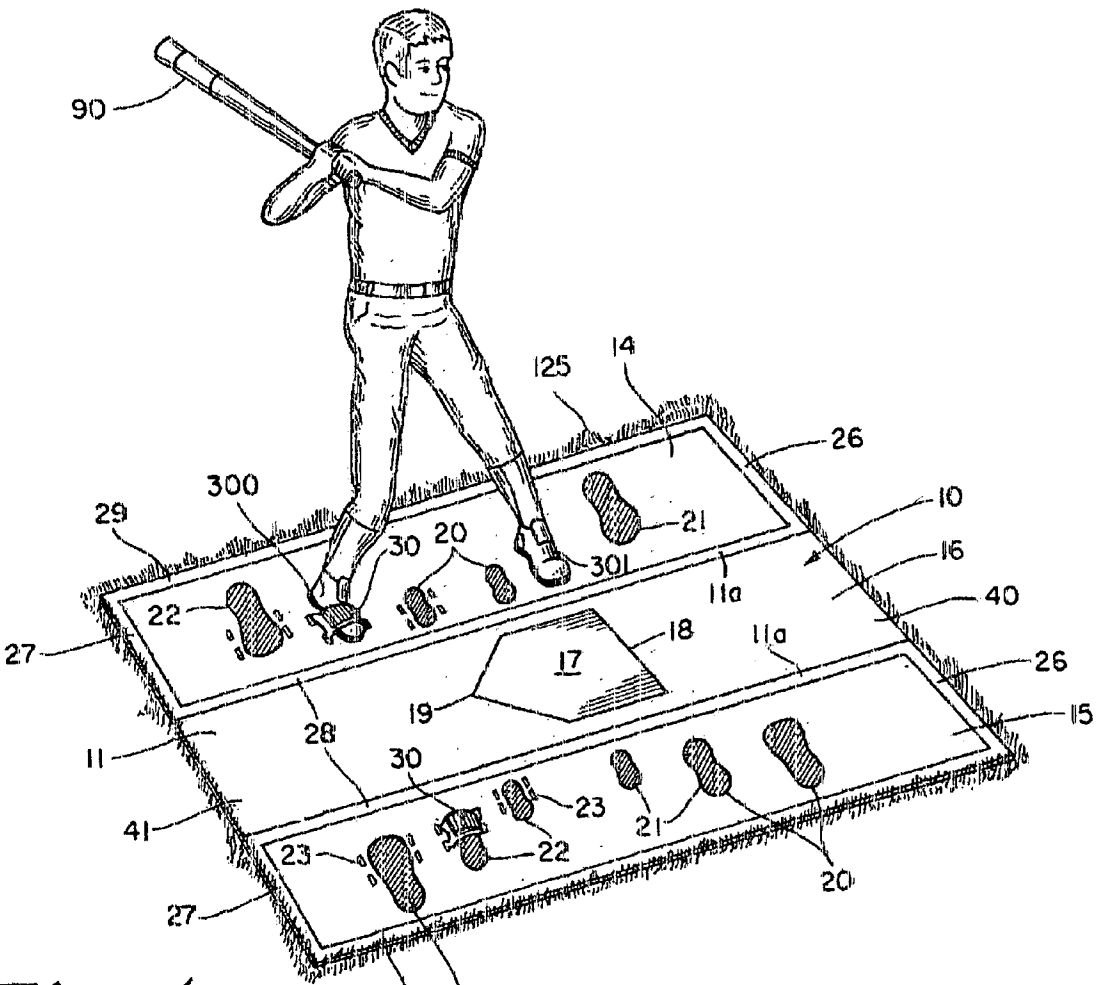
FIG. 1 is a perspective view of the preferred embodiment of the baseball batting stance training assembly being used by a medium sized batter.

Referring now to the drawings, the preferred embodiment of the present invention generally concerns a baseball batting stance training system or a baseball batting stance training assembly for use in combination with the home plate region of a baseball field.

The baseball batting stance training system or assembly is primarily designed so as to enable users thereof to improving one's batting stance as a means to improve one's hitting skills. In other words, it is contemplated that by developing a proper batting stance, the baseball player will improve the player's batting skills as earlier described.

Figure 13:
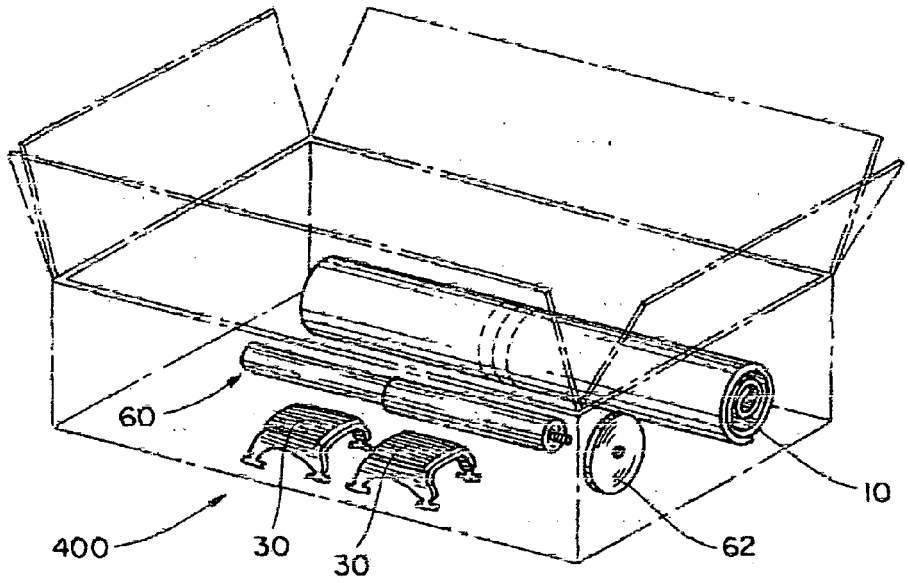
FIG. 13 is a perspective view of a baseball batting stance training kit comprising a rolled stance training mat, tee-ball assembly, and two foot-receiving cuffs depicted in a boxed arrangement.
Figure 14:
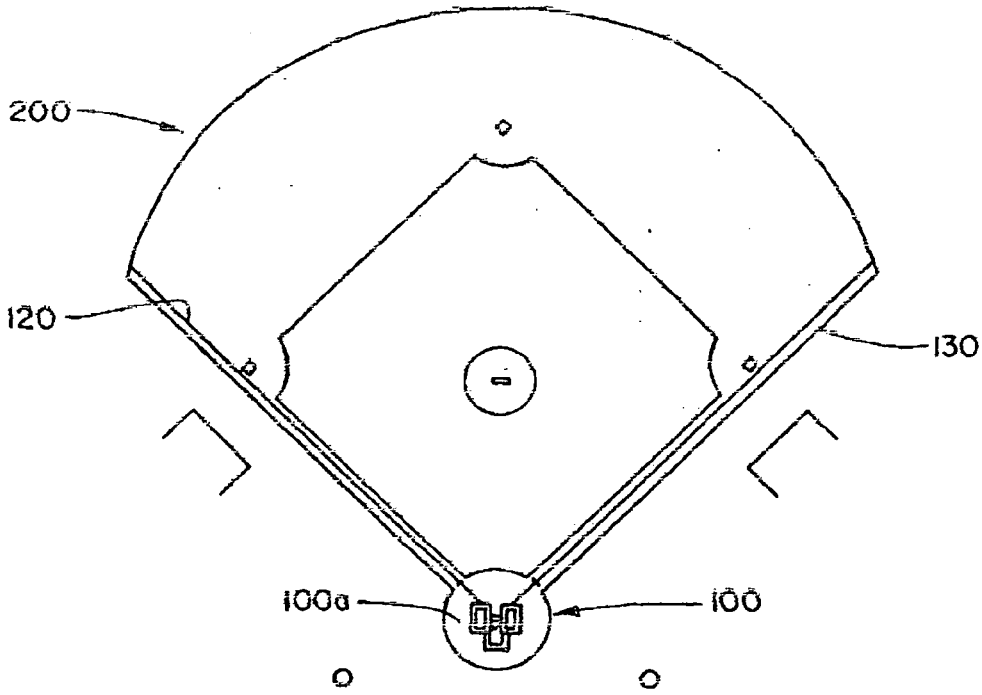
FIG. 14 is a top plan view of a prior art baseball field depicting a prior art home plate region, a prior art left field foul line, and a prior art right field foul line.

It is contemplated that the baseball batting stance training system generally comprises in combination a baseball field 200 as generally illustrated in FIG. 14; a substantially planar stance training mat 10 for placement upon baseball field 200 or similar other playing field as illustrated in FIGS. 1, 2, 4, and 13; and at least one rearward foot-receiving cuff 30 or rearward foot-receiving or holding means for removable attachment to stance training mat 10 as illustrated and referenced in FIGS. 1, 2, 4, 7–10, and 13.

Figures 2, 3:
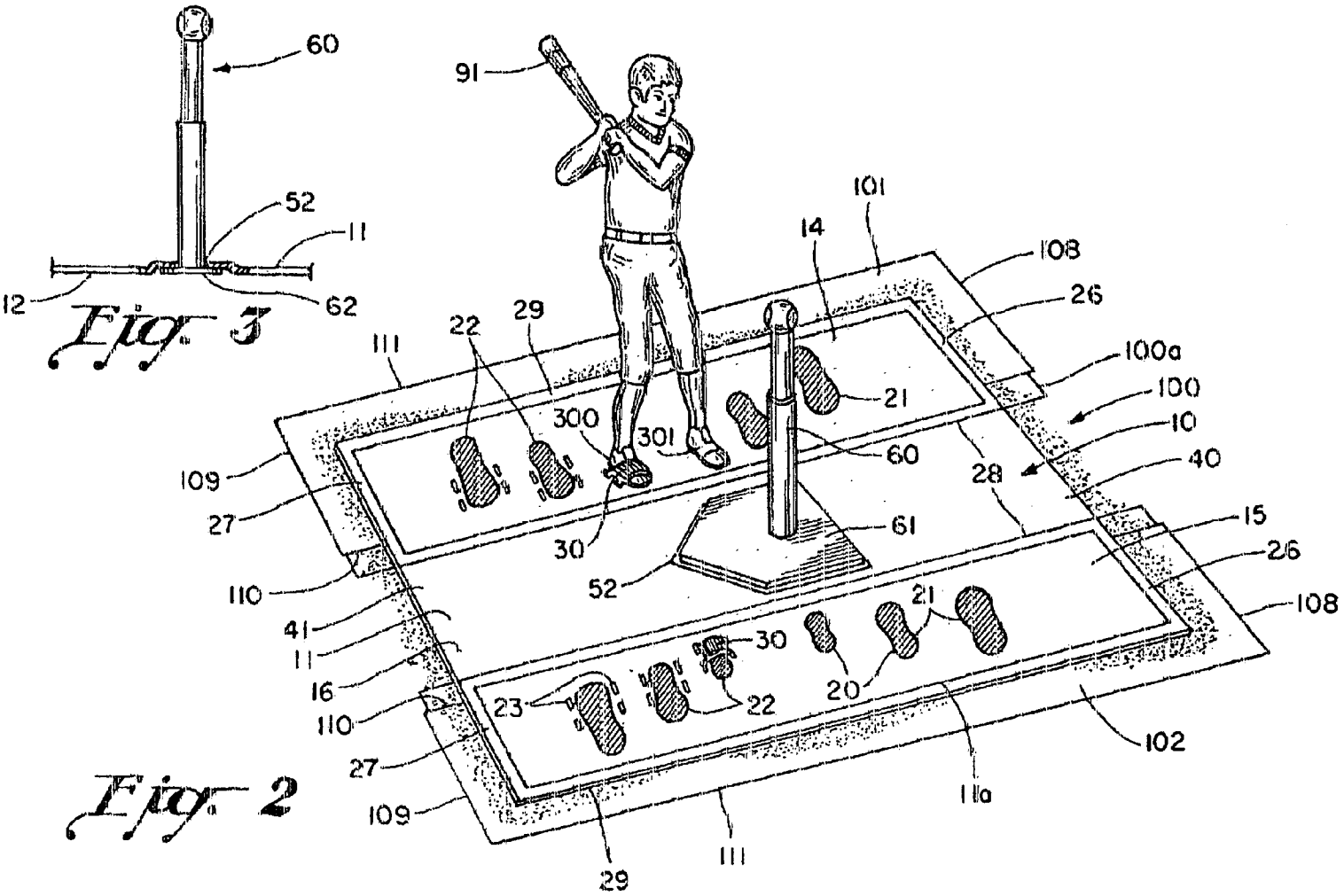
FIG. 2 is a perspective view of an alternative embodiment of the baseball batting stance training assembly being used by a small sized batter.
FIG. 3 is a fragmentary cross-sectional side view of a tee-ball assembly and stance training mat junction.
Figure 15:
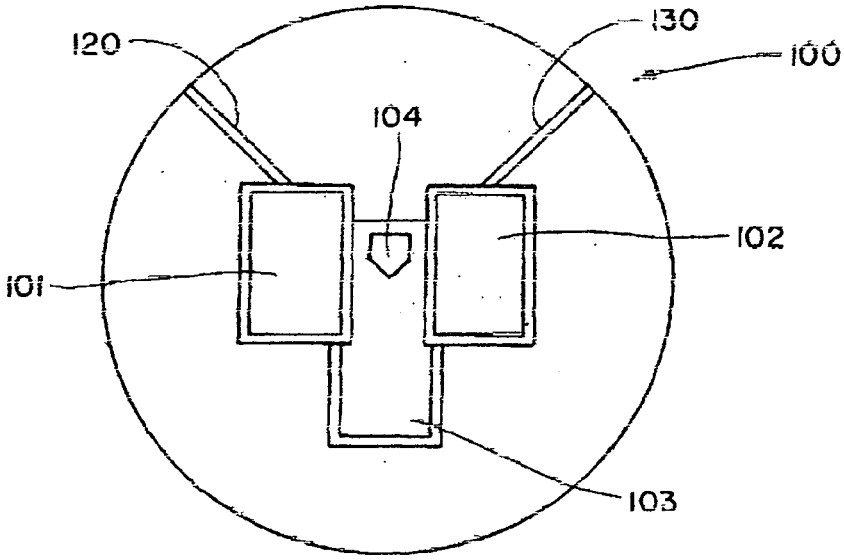
FIG. 15 is an enlarged top plan view of the prior art home plate region as illustrated in FIG. 14.
Figure 16:
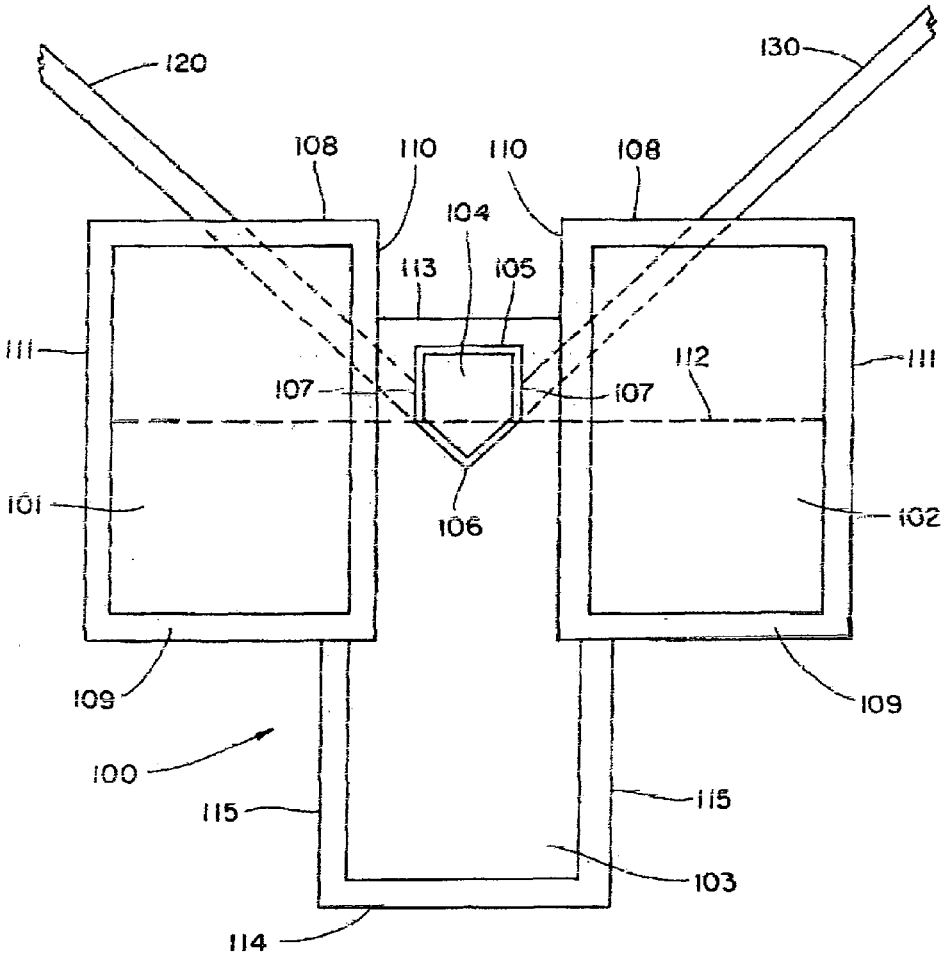
FIG. 16 is a fragmentary enlarged top plan view of the prior art home plate region as illustrated in FIG. 15.

When stance training mat 10 is used in combination with an existing baseball field and particularly in combination with a home plate region as generally illustrated in FIG. 2, it is contemplated that baseball field 200 essentially comprises a substantially planar home plate region 100 as illustrated in FIGS. 2, and 14–16; a marked left field foul line 120 as illustrated in FIGS. 14–16; and a marked right field foul line 130 as further illustrated in FIGS. 14–16. Home plate region 100 preferably comprises a substantially planar home plate region surface as referenced at 100(*a*) in FIGS. 2 and 14. Home plate region surface 100(*a*) is typically skinned or devoid of grass or similar type turf, exposing a clay or similar other earthen surface. Although the preferred embodiment is designed for use in combination with a typically marked baseball field, it should be noted that the preferred embodiment of the present invention might also be utilized on other similar playing field surfaces. For example, either impromptu or planned baseball games are often played upon unmarked open grassy spaces or alternatively, in indoor gymnasiums. Stance training mat 10 may quite easily be utilized in these scenarios. For example, an inspection of FIG. 1 will show the reader that stance training mat 10 may be unrolled from a rolled state (as comparatively shown in FIG. 13) and placed upon a grassy surface or similar other turfed surface, which surface has been referenced at 125.

Figure 12:
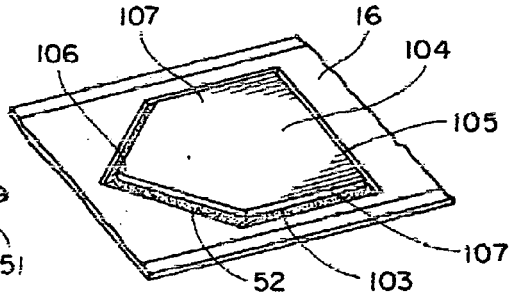
FIG. 12 is a fragmentary perspective view of a home plate being received in the home plate aperture as depicted in FIG. 11.

In a typical marked baseball field scenario, however, home plate region essentially comprises a marked left batter box 101 as illustrated in FIGS. 2, 15, and 16; a marked right batter box 102 as illustrated in FIGS. 2, 15, and 16; and a marked catcher box 103 as illustrated in FIGS. 12, 15, and 16. Catcher box 103 preferably comprises or encloses a home plate 104 as illustrated in FIGS. 12, 15, and 16, which home plate 104 essentially comprises a forward plate edge 105 and a plate apex 106 as further referenced in FIGS. 12 and 16. It will be understood from a consideration of FIG. 16 that plate apex 106 is essentially defined by the intersection of left field foul line 120 and right field foul line 130.

A standard, regulation size baseball field typically comprises a home plate region 100 that is substantially circular in configuration as generally illustrated in FIGS. 14 and 15. The circular home plate region 100 typically measures about 26 feet in diameter. Home plate 104 is typically positioned at the center of the circular home plate region 100 and typically measures seventeen (17) inches by seventeen (17) inches. As earlier indicated, home plate 104 essentially comprises a forward plate edge 105 and a plate apex 106. It should thus be noted that forward plate edge 105 measures seventeen (17) inches in length and the perpendicular distance from forward plate edge 105 to plate apex 106 is seventeen (17) inches. Connecting forward plate edge 105 to plate apex 106 are laterally opposed home plate edges 107 as further referenced in FIGS. 12 and 16.

Left batter box 101 and right batter box 102 are each substantially rectangular in configuration and in this regard preferably have a measured latitudinal dimension or width of four (4) feet and a measured longitudinal dimension or length of six (6) feet. It will be understood that left batter box 101 and right batter box 102 each further comprises a forward batter box edge 108, a rearward batter box edge 109, an inner batter box edge 110, and an outer batter box edge 111 all as referenced in FIGS. 2 and 16. Inner batter box edges 110 are preferably marked upon the substantially planar home plate region surface 100(*a*) six (6) inches from home plate edges 107. A latitudinal dividing line 112 not marked upon home plate region surface 100(*a*) (and thus shown in broken lines) divides the forward portions from the rearward portions of batter boxes 101 and 102. In this regard, it should be noted that latitudinal dividing line 112 is not visually perceived upon the home plate region 100 of baseball field 200, but may be thought of as the line defined by comprising the points measured three (3) feet from forward batter box edges 108 or three (3) feet from rearward batter box edges 109 given batter boxes 101 and 102 measuring six (6) feet along their longitudinal dimension or length. It will be understood that latitudinal dividing line 112 intersects the portion of home plate 104 where home plate edges 107 intersect the unmarked extensions of left field foul line 120 and right field foul line 130 as generally illustrated in FIG. 16. It is noted as an aside that at the time of this writing, major league level home plate regions omit inner batter box edges 110 from the home plate region. This development is not considered to materially affect the purpose or applicability of the present invention.

Catcher box 103 is substantially rectangular in configuration and is marked upon home plate region surface 100(*a*) intermediate left batter box 101 and right batter box 102. Catcher box 103 typically has a measured latitudinal dimension or width of forty-three (43) inches and a measured longitudinal dimension or length of eight (8) feet. Catcher box 103 thus comprises a forward catcher box edge 113, a rearward catcher box edge 114, and laterally opposed catcher box edges 115 as referenced in FIG. 16. Rearward catcher box 114 is preferably marked upon home plate region surface 100(*a*) six (6) feet from plate apex 106. It will thus be understood that forward catcher box edge 113 is typically marked upon home plate region surface 100(*a*) about seven (7) inches forward of forward plate edge 105. It should be further noted that overlap exists between catcher box 103 and batter boxes 101 and 102. Thus, the forward portions of catcher box edges 115 are hidden by batter boxes 101 and 102 and only the corresponding rearward portions of catcher box edges 115 are marked upon home plate region surface 100(*a*) as may be generally seen from an inspection of FIG. 16.

Figure 4:
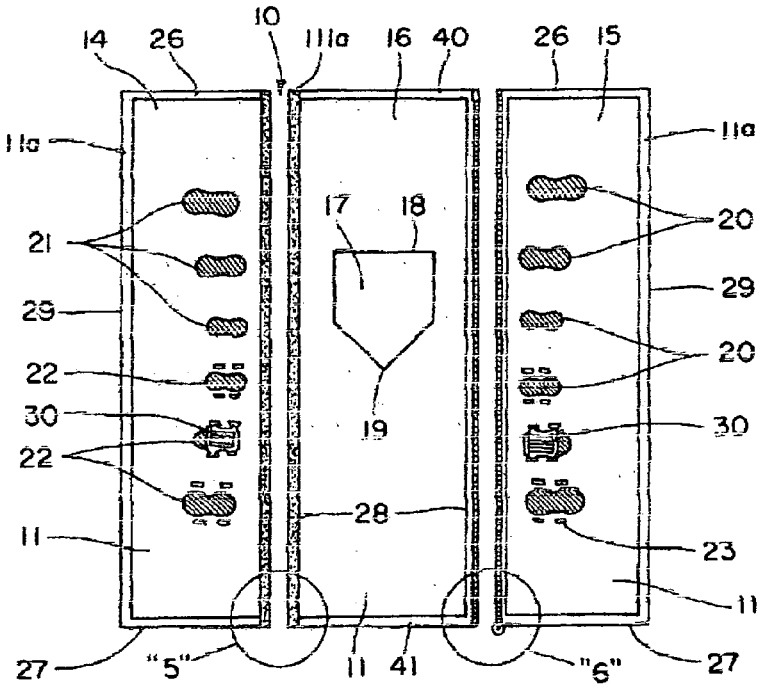
FIG. 4 is a top plan view of an alternative embodiment of the baseball batting stance training assembly depicting removable mat zones.

Stance training mat 10 is preferably substantially planar in design and in the preferred embodiment is substantially rectangular in construction as may be generally seen from an inspection of FIGS. 1, 2, and 4. Stance training mat 10 is preferably constructed from a compliant, low memory material such as heavy duty vinyl or corrugated rubber. In this last regard, it is contemplated that the manufacturer may look to state of the art materials used in manufacturing carpet runners as these types of materials provide for the required flexibility and resiliency required of stance training mat 10. As earlier indicated, it is further contemplated that stance training mat 10 may be rolled for storage and/or transport (as may be generally seen from an inspection of FIG. 13) and unrolled for use upon home plate region 100 or similar other playing field. Further stance training mat 10 must be highly resistant to punctures or tears from spikes, cleats or other foot wear having puncture-enabling structure. It is further contemplated that stance training mat 10 be constructed so as to satisfy other harsh conditions. For example, the materials used should be resistant to environmental conditions such as exposure to rain or sunlight, as well as storage conditions having wide range temperature fluctuations, such as may be seen in storage areas lacking in temperature control means. It should be further noted that when contemplated for high traffic or frequent use, the manufacturer should construct stance training mat from a thicker, heavier duty grade of material so as to withstand the likely wear and tear associated with high traffic or frequent use.

For purposes of this disclosure, it should be understood that the term "compliant" is meant to refer to the ability to readily conform to an underlying substrate such as home plate region surface 100(*a*) or similar other playing field surface. Further, it should be understood that the term "low memory" is meant to refer to the ability to rapidly comply with an underlying substrate when unconstrained from a prior condition, such as when a mat is unrolled or unfurled from a rolled or furled state. It will thus be seen that a mat constructed from vinyl or corrugated rubber or other similar materials, which are highly "compliant," and of "low memory," may readily conform to an underlying substrate such as home plate region surface 100(*a*) and may rapidly comply to a new underlying substrate when unconstrained from a prior condition, such as a rolled or furled state.

It is further contemplated that stance training mat 10 may be formed from a substantially transparent material so as to enable users to effectively align stance training mat 10 upon home plate region surface 100(*a*). In this regard, it is contemplated that a substantially transparent stance training mat 10 will not otherwise distract baseball players insofar as stance training mat 10 may be superimposed with home plate region surface 100(*a*) in a relatively inconspicuous manner. While a substantially opaque stance training mat 10 may be desired for situations in which home plate region surface 100(*a*) matches the color of an opaque stance training mat 10 or for other aesthetic reasons, users of the present invention may be desirous of utilizing the mat in a wide range of different baseball field scenarios and thus a substantially transparent stance training mat 10 is contemplated so as to enable the user to practice stance technique while not otherwise detracting from the playing surface. To further improve the visual characteristics of stance training mat 10, a superior mat surface 11 may preferably comprise indicia means 11(*a*) as referenced in FIGS. 1, 2, 4, and 9–12. Indicia means 11(*a*) function to outline various regions of stance training mat 10 as will be discussed in more detail below.

Figure 5:
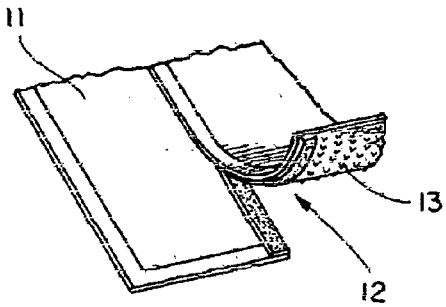
FIG. 5 is a fragmentary perspective view of a first alternative embodiment of a left mat zone and home plate zone junction as referenced in FIG. 4.
Figure 6:
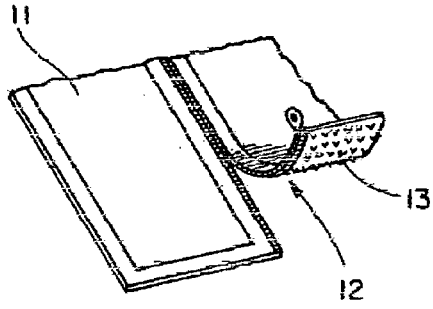
FIG. 6 is a fragmentary perspective view of a second alternative embodiment of a right mat zone and home plate zone junction as referenced in FIG. 4.

It will be understood that stance training mat 10 is primarily designed for placement upon or superimposed placement with home plate region 100. Stance training mat 10 preferably comprises the superior mat surface 11 as illustrated in FIGS. 1–8; an inferior mat surface 12 as illustrated in FIGS. 3, 5, and 6; and at least three distinct zones as may be generally seen from an inspection of FIG. 4. Inferior mat surface 12 preferably comprises anti-skid means or slip-resistant means, which may preferably be defined by studs 13 or grip-like projections as are generally illustrated in FIGS. 5 and 6. It will be understood that studs 13 or similar other grip-like projections are commonly utilized to increase the contacting surface area and thus increase the effective coefficient of friction between engaging surfaces. In this case, studs 13 or similar other grip-like projections function to increase the effective coefficient of friction between inferior mat surface 12 and the home plate region surface 100(*a*). Thus, when a downward force is placed upon stance training mat 10 such as when a player stands or assumes his stance upon stance training mat 10 as generally depicted in FIGS. 1 and 2, the anti-skid means function to keep stance training mat 10 in a stationary position so that stance training mat will not slip out from underneath the user or otherwise open the user to potential injury.

The three distinct zones may be defined by comprising a left mat zone 14 as illustrated in FIGS. 1, 2, 4, and 9; a right mat zone 15 as illustrated in FIGS. 1, 2, 4, and 10; and a home plate zone 16 as illustrated in FIGS. 1, 2, 4, and 9–12. It will be seen that in the preferred embodiment, left mat zone 14 and right mat zone 15 are aligned laterally opposite home plate zone 16 as generally illustrated in FIGS. 1, 2, and 4. Home plate zone 16 preferably comprises home plate marker means 17 or a virtual home plate as generally depicted in FIGS. 1, 4, and 9–11. Home plate marker means 17 essentially comprises a forward marker edge 18 and a marker apex 19 as illustrated in FIG. 1, 4, and 9–11. Home plate marker means 17 is primarily designed for placement upon or superimposed placement with home plate 104 such that marker apex 19 substantially coincides with plate apex 106 and forward marker edge 18 substantially coincides with forward plate edge 105. In other words, in the preferred embodiment, home plate marker means 17 is superimposed with home plate 104 such that home plate marker means 17 and home plate 104 are substantially concentric.

By placing stance training mat 10 upon home plate region 100 such that home plate marker means 17 and home plate 104 are substantially concentric, stance training mat 10 is thus positioned upon baseball field 200 to enable users to properly align themselves for pitched or positioned baseballs. Left mat zone 14 and right mat zone 15 each comprise a forward batting zone edge 26, a rearward batting zone edge 27, an inner batting zone edge 28, and an outer batting zone edge 29 as all referenced in FIGS. 1, 2, 4, 9,and 10. Left mat zone 14 and right mat zone 15 each preferably measure about two (2) feet along forward batting zone edge 26 and rearward batting zone edge 27 and further measure about six (6) feet along inner batting zone edge 28 and outer batting zone edge 29. Home plate zone 16 comprises a forward catcher zone edge 40 and a rearward catcher zone edge 41 as referenced in FIGS. 1, 2, 4, 9, and 10. Forward catcher zone edge 40 and rearward catcher zone edge 41 each preferably measures about twenty-nine (29) inches. Thus stance training mat 10 measures about seventy-seven (77) inches (along the forward and rearward dimensions) by seventy-two (72) inches (along the laterally opposed dimensions). Since the approximate measured distance between laterally opposed inner batter box edges 110 is twenty-nine (29) inches, it will be understood that inner batting zone edges 28 are preferably designed for placement upon or superimposed placement with inner batter box edges 110 as generally illustrated in FIG. 2. Notably, however, left mat zone 14 and right mat zone 15 have a combined surface area less than the combined surface area of left batter box 101 and right batter box 102 and thus outer batting zone edges 29 do not coincide with outer batter box edges 111 as generally depicted in FIG. 2. It is believed that a stance training mat 10 sized so as to superimpose batting zone edges 28 upon inner batter box edges 110 as well as superimpose batting zone edges 29 upon outer batter box edges 111 would become unwieldy. The purpose of stance training mat 10 is not to signal to other players that the hitter is ready to play (as for example by stepping into the batter box), but rather to properly align the hitter's feet within the respective mat zone atop a respective batter box and thus it is contemplated that left mat zone 14 or right mat zone 15 need not approximate the size of left batter box 101 or right batter box 102.

As earlier indicated, indicia means 11(*a*) are primarily designed to visually outline at least two of the described zones as generally depicted in FIG. 1. It is contemplated that by outlining at least two of the described zones, the user may more easily properly position himself or herself upon the stance training mat. It is further contemplated, however, that indicia means 11(*a*) may also function to visually outline home plate marker means 17 (not illustrated). In any event, home plate marker means 17 is preferably provided with contrasting coloration as compared to the remainder of stance training mat 10 so as to enable the users or other players or umpires to more readily perceive home plate marker means 17. Specifically, it is contemplated that home plate marker means 17 be provided with light reflective coloration or white coloration so as to more closely resemble a home plate, thereby enabling players or umpires to more readily perceive the strike zone or enabling batters to more properly align themselves.

Left mat zone 14 and right mat zone 15 each preferably comprise a plurality of foot print indicia 20 as illustrated in FIGS. 1, 2, 4, 9, and 10 and cuff-engaging means. Foot print indicia 20 preferably comprise anti-skid or slip-resistant means to further improve the safety features of stance training mat 10. The anti-skid or slip resistant means may be defined by any of a variety of slip-resistance coatings or products such as those utilizing graded aggregates to create more surface area to effectively increase the coefficient of friction between engaging surfaces, namely, the inferior foot print indicia-engaging surfaces of the user's feet and the foot-engaging surfaces of foot print indicia 20. Foot print indicia 20 comprise at least one, but preferably three, forward foot markers 21 as referenced in FIGS. 1, 2, 4, 9, and 10; and at least one, but preferably three, rearward foot markers 22 as referenced in FIGS. 1, 2, 4, 9, and 10. The number of forward foot markers 21 and rearward foot markers 22 is more a matter of design choice than criticality to the function of stance training mat 10. It is contemplated that foot print indicia 20 are included in the design of stance training mat 10 so as to allow users or players of varying bodily sizes to properly utilize stance training mat 10.

A comparison of FIGS. 1 and 2 will show that players of larger or medium size (as generally illustrated in FIG. 1) will necessarily have a wider foot stance than players of smaller or small size (as generally illustrated in FIG. 2). It will thus be seen that a relatively small size player or batter may properly position himself upon stance training mat 10 such that his forward foot 301 is placed upon a forward foot marker 21 and his rearward foot 300 is placed upon a rearward foot marker 22, which foot markers are spatially located relatively nearer latitudinal dividing line 112 than are other foot markers 21 and 22 which are spatially located relatively farther from latitudinal dividing line 112.

FIG. 2 thus generally depicts a small size batter with a forward foot 301 upon a forward foot marker 21 and his rearward foot 300 upon a rearward foot marker 22. By way of comparison, FIG. 1 generally depicts a larger or medium size batter with a forward foot 301 upon a forward foot marker 21 that is intermediate a smallest size forward foot marker 21 and a largest size forward foot marker 21. Similarly, FIG. 1 further depicts a larger or medium size batter with a rearward foot 300 upon a rearward foot marker 22 that is intermediate a smallest size rearward foot marker 22 and a largest size rearward foot marker 22.

It will be further seen from an inspection of FIGS. 1, 2, 4, 9, and 10 that the so-called smallest size foot markers 21 and 22 are spatially located nearer inner batter box edges 110 or inner batting zone edges 28 than are the so-called largest size foot markers 21 and 22. It will be understood that larger players typically must position themselves further from home plate 104 so that the head of the baseball bat, when swung, covers the outside edge of home plate 104. Should a smaller size batter position himself too far from home plate 104 or inner batter box edge 110, the head of an appropriately sized baseball bat for that individual may not cover the outside edge of home plate 104, thus decreasing the likelihood of the batter's success while at the plate.

In the preferred embodiment, it is contemplated that the foot markers 21 and 22 are each positioned atop stance training mat 10 at varying distances from inner batting zone edges 28 depending on the foot marker. In this regard, it is contemplated that the smallest size foot markers 21 and 22 are each positioned atop stance training mat 10 such that the forward tip of the respective marker is positioned approximately 4.5 inches from inner batting zone edges 28; the medium size foot markers 21 and 22 are each positioned atop stance training mat 10 such that the forward tip of the respective marker is positioned approximately 7.25 inches from inner batting zone edges 28; and the largest size foot markers 21 and 22 are each positioned atop stance training mat 10 such that the forward tip of the respective marker is positioned approximately 8.75 inches from the respective inner batting zone edges 28. The smallest forward foot markers 21 are each preferably positioned such that the forward most edges of the same are approximately 22.75 inches from the respective forward batting zone edges 26; the smallest rearward foot markers 22 are each preferably positioned such that the forward most edges of the same are approximately 33 inches from the respective forward batting zone edges 26; the medium sized rearward foot markers 22 are each preferably positioned such that the forward most edges of the same are approximately 39.5 inches from the respective forward batting zone edges 26; and the largest rearward foot markers 22 are each preferably positioned such that the forward most edges of the same are approximately 45.25 inches from the respective forward batting zone edges 26.

Since it has been noted that a basic parallel batting stance enables novice hitters to develop proper stance technique, both forward foot markers 21 and rearward foot markers 22 have a longitudinal axis, each longitudinal axis being substantially parallel with forward marker edge 18. It will thus be understood that by providing foot print indicia 20 having longitudinal axes or axes through the length of the overall foot print indicia, the user or batter may properly align his or her feet in a parallel stance adjacent home plate 104.

The cuff-engaging means are preferably located adjacent each rearward foot marker 22 and in this regard may preferably be defined by a plurality of tab-receiving apertures 23 as referenced in FIGS. 1, 2, 4, 7–10. It will be seen from an inspection of the noted figures that each rearward foot marker 22 comprises four (4) tab-receiving apertures 23. Tab-receiving apertures 23 thus comprise at least one, but preferably two, forward apertures 24 and at least one, but preferably two rearward apertures 25 as specifically referenced in FIGS. 7 and 8. Each tab-receiving aperture 23 extends from superior mat surface 11 to inferior mat surface 12.

As earlier stated, it is contemplated that the baseball training system further comprises at least one, but possibly two, rearward foot-receiving cuffs 30 as illustrated in FIGS. 1, 2, 4, and 7–10. Since rearward foot-receiving cuffs 30 are designed to be removably attachable to stance training mat 10, it is contemplated that a single foot-receiving cuff 30 is usable either in left mat zone 14 or right mat zone 15. However, should the user so desire, two foot-receiving cuffs 30 may be provided with the preferred embodiment as generally depicted in FIGS. 1, 2, and 4. Additionally, it should be noted that if lost or broken, foot-receiving cuff 30 may be easily replaced by the user by purchasing replacement one or several foot-receiving cuffs 30.

Figure 7:
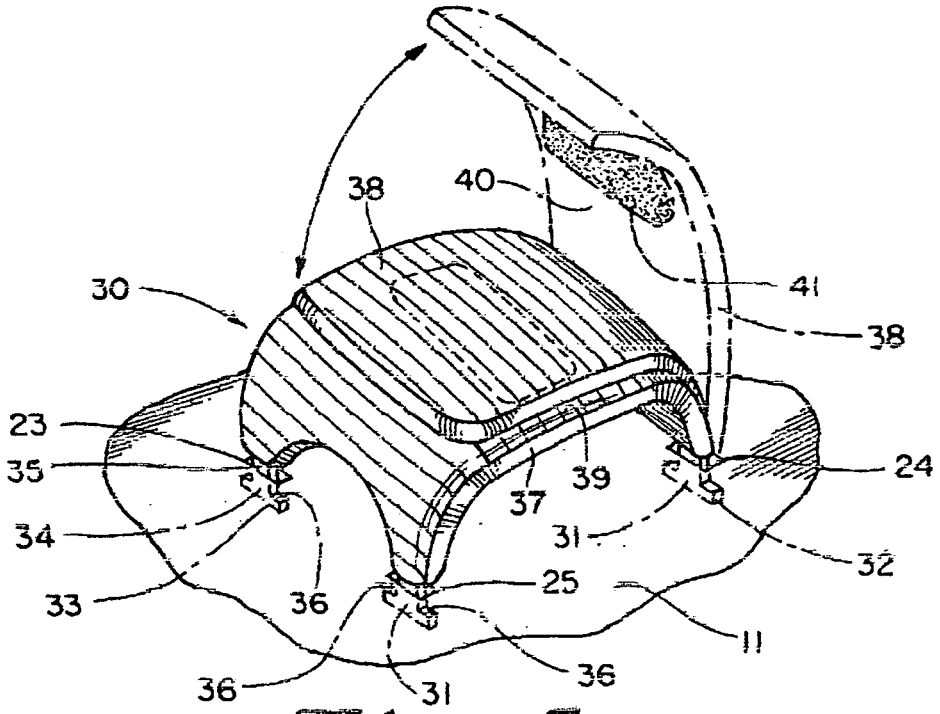
FIG. 7 is a fragmentary perspective view of the stance training mat and foot-receiving cuff junction.
Figure 8:
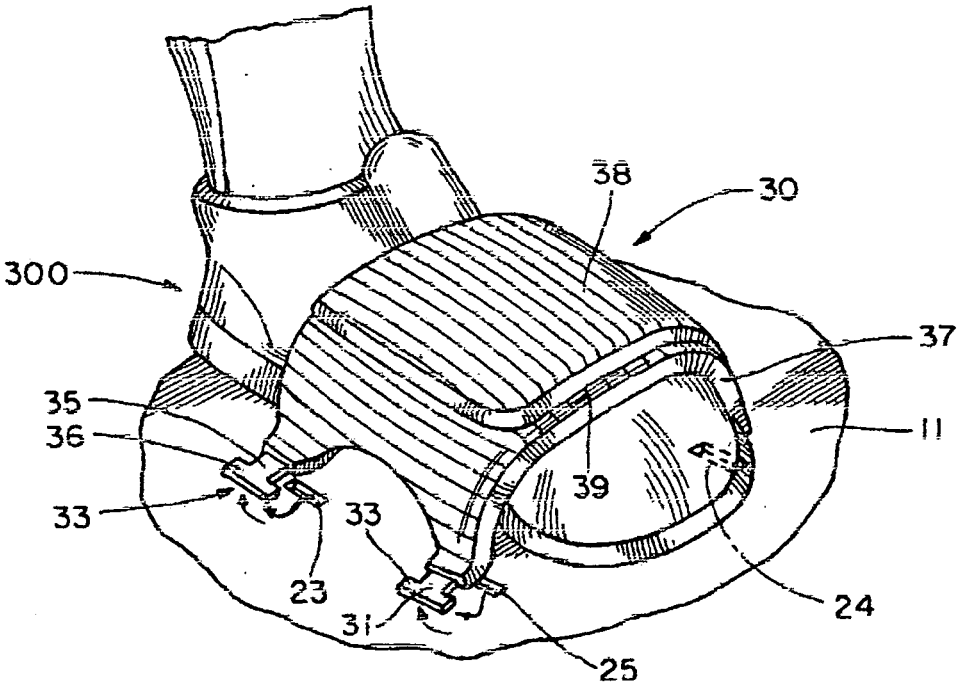
FIG. 8 is a fragmentary perspective view of the stance training mat and foot-receiving cuff junction depicting a rearward foot being received in the foot-receiving cuff.
Figure 9:
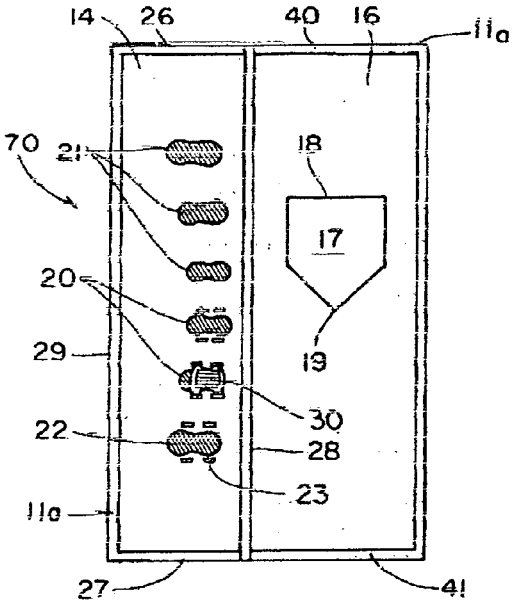
FIG. 9 is a top plan view of an alternative embodiment of the baseball batting stance training assembly showing a left mat zone integrally connected to a home plate zone.
Figure 10:
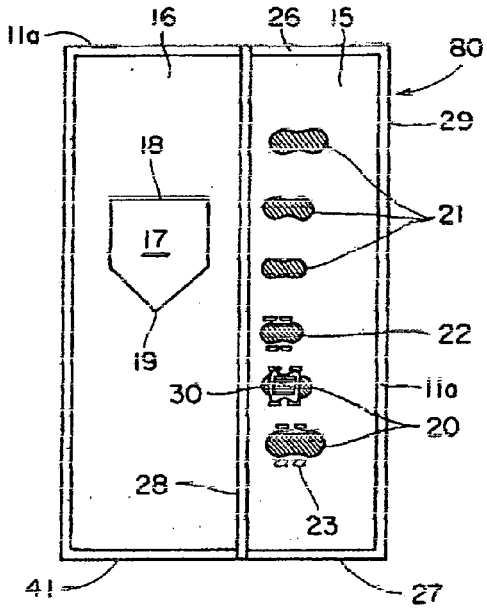
FIG. 10 is a top plan view of the an alternative embodiment of the baseball batting stance training assembly showing a right mat zone integrally connected to a home plate zone.

Each foot-receiving cuff 30 essentially comprises superior foot-positioning means and inferior mat-engaging means, the mat-engaging means for breakaway or removable attachment to the cuff-engaging means. The foot-positioning means and the mat-engaging means are preferably constructed from superior grade, flexible, high memory rubber or similar other material which may be flexed to enable receipt of rearward foot 300 as generally depicted in FIGS. 7 and 8 and for removable attachment or breakaway attachment to stance training mat 10. Thus, the material utilized should be capable of flexure, but returnable to its original configuration under forces inherent in its internal structure.

As earlier described, the cuff-engaging means are preferably defined by a plurality of tab-receiving apertures 23. It follows that the mat-engaging means may preferably be defined by a plurality of retention tabs 31 as illustrated in FIGS. 7 and 8. Each retention tab 31 preferably comprises at least one, but preferably two, forward tabs 32 as referenced in FIG. 7, and at least one, but preferably two, rearward tabs 33 as further referenced in FIGS. 7 and 8. It will be noted from an inspection of FIGS. 7 and 8 that each retention tab 31 further comprises a tab stop 34 and a tab shaft 35. Tab shafts 35 each have a shaft axis, each shaft axis being substantially orthogonal to planar stance training mat 10 when inserted in tab-receiving apertures 23 as generally depicted in FIGS. 7 and 8.

It will be understood from a consideration of FIGS. 7 and 8 that each tab shaft 35 is removably received in one of the tab-receiving apertures 23. Each tab stop 34 has a stop surface area 36 and breakaway means. When each tab shaft 35 is removably received in one of the tab-receiving apertures 23, each stop surface area 36 becomes substantially parallel with the planar stance training mat 10 as generally depicted in FIG. 7. Each stop surface area 36 thus contacts inferior mat surface 12 when the rearward foot 300 is placed upon a rearward foot marker 22 in foot-receiving cuff 30. By thus contacting inner mat surface 12, the collective stop surface area 36 create oppositely directed cuff-retaining forces having a downward magnitude and cuff-removing forces having an upward magnitude. When these opposing forces balance each other, there is no net movement of foot-receiving cuff 30. However, when the upward magnitude exceeds the downward magnitude such as when rearward foot 300 twists during a swing or is otherwise pulled upward such as during loss of balance or when the user otherwise intentionally removes foot-receiving cuff 30 from stance training mat 10, the net force is directed upward and thus foot-receiving cuff 10 accelerates in an upward fashion according to classical physical principles. The breakaway means, thus enabled by the actions of flexible, high memory rubber under a net cuff-removing force, may be defined by the flexure of the materials constituting tab stops 34 and or the materials constituting stance training mat 10 adjacent tab-receiving apertures 23. In other words, given a net cuff removing force, tab stops 34 or mat portions adjacent tab-receiving apertures 23 will flex, thereby allowing tab stops 34 to pull through tab-receiving apertures 23 and enabling foot-receiving cuff 30 to breakaway from stance training mat 10.

It will thus be understood that the mat-engaging means are capable of providing downwardly-acting, cuff-retaining forces and upwardly acting, cuff-removing forces as tab stops 34 contact inferior mat surface 12. Material characteristics inherent in tab stops 34 and tab-receiving apertures 23 provide the maximum downward forces withstandable by the assembly. Materials such as rubber or vinyl are flexible yet sufficiently resilient to allow either tab stops 34 or those potions of stance training mat 10 adjacent tab-receiving apertures 23 to flex and allow tab stops 34 to pull through tab-receiving apertures 23 when the cuff-removing forces exceed the cuff-retaining forces.

The baseball training system or assembly thus enables a user to place forward foot 301 upon forward foot marker 21 and rearward foot 300 upon rearward foot marker 22 in foot-receiving cuff 30. It is noted that the user is capable of creating upwardly acting, cuff-removing forces for example, either by manual hand removal of foot-receiving cuff 30 or by foot removal of foot-receiving cuff 30. In the latter scenario, it is noted that rearward foot 300 is capable of creating upwardly acting, cuff-removing forces having an upward magnitude as has been described and the mat-engaging means thus enable foot-receiving cuff 30 to breakaway from stance training mat 10 should the upward magnitude exceed the downward magnitude.

The foot-positioning means are primarily designed to properly align rearward foot 300 along the rearward longitudinal axis and forward foot 301 along the forward longitudinal axis. The foot-positioning means are preferably defined by a flap assembly as generally depicted in FIGS. 7 and 8. The flap assembly preferably comprises a foot-engaging first flap 37 and a flap-securing second flap 38. First flap 37 preferably comprises an inferior foot-engaging surface as may be understood from a general inspection of FIG.8, and a superior second flap-engaging surface 39 as particularly referenced in FIGS. 7 and 8. Second flap 38 preferably comprises an inferior first flap-engaging surface 40 as referenced in FIG. 7. Superior second flap-engaging surface 39 and inferior first flap-engaging surface 40 each preferably comprise matable fastening means as generally depicted in FIG.7. The inferior foot-engaging surface is designed primarily for receiving rearward foot 300, and the matable fastening means is designed primarily for removably securing second flap 38 to first flap 37. The matable fastening means may preferably be defined by matable hook and loop fastening means as referenced at 41 in FIG. 7. Excellent results have been obtained using VELCRO brand hook and loop fastening means as the preferred matable hook and loop fastening means. It should be further noted that foot-receiving cuff 30 is preferably adjustable by way of the matable fastening means so as to accept variously sized feet. In practice it is important to have a snug fit around the user's rearward foot so the proper batting stance technique will be maintained throughout the batting event.

It will thus be seen that the engaged forward foot marker 21, the engaged rearward foot marker 22 and foot-receiving cuff 30 function to properly align a user's feet thereby improving the baseball player's or user's batting stance. By properly aligning the player's feet in a basic parallel stance, it is believed that the novice hitter will develop proper stance technique. Further, when a downward force is placed upon stance training mat 10 such as when a player stands or takes a basic parallel stance upon stance training mat 10, the anti-skid means function to keep engaging surfaces in a high friction state thus decreasing skid or slip tendencies as the user stands atop stance training mat 10. The anti-skid means located on inferior mat surface 12 enable stance training mat 10 to remain stationary when the user places forward foot 301 upon forward foot marker 21 and rearward foot 300 upon rearward foot marker 22 in foot-receiving cuff 30 and the anti-skid means located on foot print indicia 20 function to keep the user's feet from slipping from foot print indicia 20.

It will thus be seen that the stance training mat of the present invention is designed for placement upon the home plate region and preferably comprises a superior mat surface, an inferior mat surface, and at least three zones, the zones comprising a left mat zone, a right mat zone, and a home plate zone. The left and right mat zones are aligned laterally opposite the home plate zone, which home plate zone comprises home plate marker means comprising a forward marker edge and a marker apex. The home plate marker means are for placement upon the home plate, the marker apex substantially coinciding with the home plate apex and the forward marker edge substantially coinciding with the forward plate edge.

The left and right mat zones each preferably comprise a plurality of foot print indicia or foot outlines and a plurality of tab-receiving apertures 23 (the inferior mat surface and the foot outlines preferably comprising anti-skid means). The foot outlines comprise a series of substantially parallel forward foot markers and a series of substantially parallel rearward foot markers, the forward and rearward foot markers each being substantially parallel with the forward marker edge. Each rearward foot marker comprises an anterior foot region, a posterior foot region, a metatarsal foot region, a medial foot region, and a lateral foot region all as generally depicted in FIGS. 1, 2, and 4. It will be seen from an inspection of the noted figures as well as from a consideration of classical anatomical principles that the metatarsal region extends intermediate the anterior and posterior foot regions. It will be further seen from an inspection of the noted figures that a set of four tab-receiving apertures 23 are cooperatively associated with each rearward foot marker and defined by two forward apertures and two rearward apertures on opposing sides of the rearward foot marker, (i.e. a medial anterior aperture, a lateral anterior aperture, a medial posterior aperture, and a lateral posterior aperture). The tab-receiving apertures 23 extend from the superior mat surface to the inferior mat surface adjacent the metatarsal regions.

The foot-receiving cuff comprises certain superior foot-positioning means and four retention tabs 31 for breakaway engagement with a select set of tab-receiving apertures 23, the four retention tabs being defined by two forward tabs and two rearward tabs on opposing sides of the foot-receiving cuff, (i.e. a medial anterior tab, a lateral anterior tab, a medial posterior tab, and a lateral posterior tab). The retention tabs 31 each comprise a substantially planar tab stop and a tab shaft removably received through the tab-receiving apertures 23. The tab shafts are substantially orthogonal to the stance training mat and the tab stops are substantially parallel with the stance training mat when inserted through the tab-receiving apertures 23. The retention tabs 31 and the select set of tab-receiving apertures 23 thus enable forced breakaway from the stance training mat. The forward foot markers, the rearward foot markers, and the foot receiving cuff together cooperate to align the user's feet, and thus, the baseball training system functions to improve the user's batting stance.

The baseball training system may further comprise a tee-ball assembly 60 as generally depicted and referenced in FIGS. 2, 3, and 13. Tee-ball assemblies are often utilized to teach novice hitters proper hitting technique and thus it is contemplated that tee-ball assembly 60 may be utilized in combination with the preferred embodiment of the present invention so as to develop proper stance technique as well as hitting technique in novice or beginner hitters. Essentially, tee-ball assembly 60 comprises a tee-ball stand, which tee-ball stand may be cooperatively associated with or removably placed upon a select home plate structure, namely, home plate marker means 17. It is further contemplated in this last regard, however, the tee-ball assembly may also be placed on other select home plate structure as is discussed in the below section entitled, Alternative Embodiment No. 1.

Alternative Embodiment No. 1

A first alternative embodiment of the present invention is virtually identical to the preferred embodiment of the present invention except for certain features that are removable from stance training mat 10. In this regard the descriptions of each of the features noted above are incorporated here by reference thereto, but may be further described in relevant portion as follows.

Figure 11:
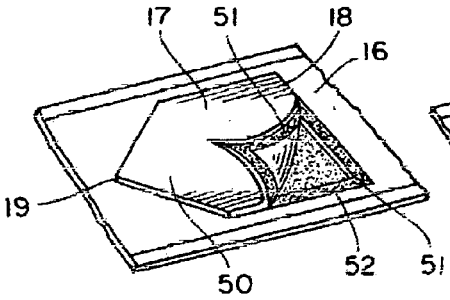
FIG. 11 is a fragmentary perspective view of an alternative embodiment of home plate marker means being removed from the home plate zone to form a home plate aperture.

It is contemplated that the select home plate structure may be selected from the group consisting of home plate marker means 17 as described above or a home plate aperture. In this regard, it is contemplated that home plate marker means 17 may preferably be defined by a removable home plate pattern 50 as generally depicted in FIG. 11. From an inspection of FIG. 11, will be seen that home plate marker means 17 comprise removable attachment means 51 for removably attaching home plate pattern 50 to home plate zone 16. It will thus be understood that selectively removable home plate pattern 50 enables a user to selectively form a home plate aperture 52 as referenced in FIGS. 2, 3, 11, and 12. Home plate aperture 52 is designed to expose a selected home plate pattern, the selected home plate pattern being selected from the group consisting of a typically sized and shaped home plate receiving pattern as generally depicted in FIGS. 11, and 12 and a tee-ball assembly-receiving pattern as generally depicted in FIGS. 2 and 3. From an inspection of FIGS. 11 and 12 it will be understood that the selected home plate pattern is designed to expose home plate 104 in its entirety to enable the players or umpires to more easily perceive home plate 104 and/or to enable batters to more properly align themselves. From an inspection of FIGS. 2 and 3 it will be understood that the select home plate pattern is designed to expose an aperture for cooperative association with a tee-ball assembly, namely, to receive certain structure of the tee-ball assembly. It is noted that tee-ball assemblies generally comprise a tee-ball stand, the base of which may mirror a home plate configuration as is generally illustrated in FIG. 12. However, a tee-ball stand need not have a base having a home plate configuration and instead may be circular or rectangular in design. Should the tee-ball stand comprise a base having a shape other than the typical shape of a home plate, it is contemplated that the select home plate pattern comprise a shape to receive the base or in the alternative to receive the upright ball-supporting member of the tee-ball stand such as is generally depicted in FIG. 3 where the base portion 62 of a tee-ball stand is located in inferior adjacency to stance training mat 10. The select home plate pattern thus exposes an aperture for receiving either a base or an upright member of tee ball assembly 60 and the base may be positioned either directly upon home plate 104, or directly upon home plate region surface 100(*a*) in the event no home plate is provided.

It is further contemplated that other removable portions of stance training mat 10 be provided. For example, as generally illustrated in FIGS. 4–6, inclusive, left mat zone 14 and/or right mat zone 15 may be removably attached to home plate zone 16.

Removable attachment means enable the user at his or her election to remove one of the respective mat zones. It is contemplated that right-handed users of the present invention may desire to obtain a stance training mat 10 comprising a select mat zone or select batting box, the select mat zone or select batting box being selected from the group consisting of the left mat zone and the right mat zone. In other words, it is contemplated that right handed users of the present invention may desire to obtain a stance training mat 10 comprising only left mat zone 14 and home plate zone 16. In this regard, right mat zone 15 may be simply detached from home plate zone 16 via the removable attachment means. It is contemplated that the removable attachment means may comprise any of a number of means for removably attaching structures to one another. As shown in FIGS. 4 and 5, it is contemplated that matable hook and loop fastening means may be utilized as removable attachment means. Alternatively, a further example of removable attachment means may be slide fastening means or zipper means as generally depicted in FIGS. 4 and 6. Thus, the first alternative embodiment of the present invention further contemplates left and right mat zones 14 and 15 that are removably attached to home plate zone 16, thus enabling a user to selectively remove a select batting zone from home plate zone 16, the select batting zone being selected from the group consisting of left mat zone 14 and right mat zone 15. It should be noted that if the manufacturer elects to construct the present invention with removable attachment means as described herein, the manufacturer should be careful to keep the attachment zone or seam relatively planar so that users of the present invention will not trip over otherwise elevated seams.

As has been described, it is contemplated that in the first alternative embodiment, certain structures may be removably attached to stance training mat as herein described. It is further contemplated, however, that users of the present invention may desire to obtain and utilize a device substantially as described herein, but where certain structures are not removable. Alternative Embodiment No. 2, as described below, addresses these contemplated inventive features of the present invention.

Alternative Embodiment No. 2

A second alternative embodiment of the present invention is virtually identical to the preferred embodiment of the present invention except for certain features that are permanently removed from the stance training mat. As will be seen from an inspection of FIG. 9, it is contemplated that a stance training mat 70 essentially comprises left mat zone 14 and home plate zone 16, but excludes right mat zone 15. Stance training mat 70 is thus designed for right-handed hitters who are desirous of obtaining and utilizing a stance training structure having a non-removable mat zone, which structure excludes right mat zone 15 as superfluous structure. Similarly, as will be seen from an inspection of FIG. 10, it is contemplated that a stance training mat 80 essentially comprises right mat zone 15 and home plate zone 16, but excludes left mat zone 14. Stance training mat 80 is thus designed for left-handed hitters who are desirous of obtaining and utilizing a stance training structure having a non-removable mat zone, which structure excludes left mat zone 14 as superfluous structure.

It should be noted that home plate marker means 17 may or may not be defined by removable home plate pattern 50 as earlier described. While left mat zone 14 or right mat zone 15 may be superfluous depending on whether the user is right-handed or left-handed, home plate marker means 17 is typically not superfluous for either right-handed or left-handed hitters and thus it is contemplated that removable home plate pattern 50 may be included in the design of either stance training mat 70 or stance training mat 80.

Kit Considerations

As a final descriptive point, it is contemplated that the present invention may be made available to consumers in kit form or as a baseball training kit for outfitting a playing field and improving a user's batting stance as generally depicted in FIG. 13 and referenced at 400. It will be understood that kit 400 may comprise any of the structures as herein defined and described, but packaged together in varying combinations as the consumer demands. Essentially kit 400 may comprise stance training mats 10, stance training 70, or stance training mat 80. Should the user be desirous of obtaining stance training mat 10, it is contemplated that, per the first alternative embodiment, kit 400 may comprise left mat zone 14 and right mat zone 15 where left mat zone 14 and right mat zone 15 are removable from home plate zone 16. Notably, home plate marker means 17 may or may not be removable per the user's demand. Kit 400 should also comprise at least one foot-receiving cuff 30 substantially as described above, but possibly may comprise two foot-receiving cuffs 30 as generally further depicted in FIG. 13. Lastly, kit 400 may comprise tee-ball assembly 60, which assembly may comprise a base of any of a wide variety of shapes. For purposes of description clarity, the base may have a home plate shape as generally illustrated in FIG. 2 at 61 or may comprise a circular base as generally depicted in FIGS. 3 and 13 at 62.

It will be recalled that that the so-called smallest size foot markers 21 and 22 are spatially located nearer inner batter box edges 110 or inner batting zone edges 28 than are the so-called largest size foot markers 21 and 22. It will be understood that larger players typically must position themselves further from home plate 104 so that the head of an appropriately sized baseball bat for the batter will cover the outside edge of home plate 104 when swung. It was noted that should a smaller size batter position himself too far from home plate 104 or inner batter box edge 110, the head of an appropriately sized baseball bat for that individual may not cover the outside edge of home plate 104, thus decreasing the likelihood of the batter's success while at the plate. It is thus contemplated that the kit form of the present invention may further comprise at least one baseball bat 90 of appropriate or user-selected length so that the batter will be enabled to more properly position himself or herself atop stance training mat and thus develop proper stance technique. Baseball bat 90 is illustrated in FIG. 1 and a baseball bat 91 is illustrated in FIG. 2. From a comparative inspection of FIGS. 1 and 2, the reader will see that baseball bat 90 has a length greater in magnitude than the length of baseball bat 91. In other words, the medium size user of the present invention will typically select a baseball bat of greater length than a small size user of the present invention and thus it is contemplated that the kit form of the present invention may include a baseball bat, the baseball bat being of user-selected length.

It will thus be understood that the present invention provides a baseball batting stance training system comprising, in combination, a baseball field, a substantially planar stance training mat for placement upon the home plate region of the baseball field, and at least one rearward foot-receiving cuff for removable or breakaway attachment to the stance training mat. It will be further understood that the present invention provides a stance training mat that is substantially rectangular and planar in design and constructed from a compliant, low memory material comprising a superior mat surface, an inferior mat surface, and at least three distinct zones. The present invention further provides a stance training mat comprising three distinct zones defined by a left mat zone, a right mat zone, and a home plate zone, which zones collectively enable users thereof to selectively learn or develop proper batting stance technique on either side of the home plate zone.

Further, it will be understood that present invention provides left and right mat zones aligned laterally opposite a home plate zone wherein the left and right mat zones each comprise foot print indicia defined by forward foot markers and rearward foot markers. In this regard, it will be understood that the present invention provides rearward foot markers that comprise structure for receiving a breakaway foot-receiving cuff. It will be further understood that the present invention provides a foot-receiving cuff designed to properly position the rearward foot and for providing breakaway attachment means for detaching the foot-receiving cuff from the stance raining mat in a breakaway manner so as to prevent unfortunate injury to the user.

While the above description contains much specificity, this specificity should not be construed as limitations on the scope of the invention, but rather as an exemplification of the invention. For example, the invention may be described as a baseball training structure comprising a flexible mat, which flexible mat is storable in a rolled form and unrollable for use as a baseball training device. The flexible mat may comprise indicia means, rear foot holding means or rearward foot-receiving means, and breakaway means. The indicia means function to simulate a home plate region, which home plate region comprises a home plate simulation. The indicia means may further define a batter's box located on ether one side of the home plate simulation or on both sides of the home plate simulation. The rear foot holding means or rearward foot-receiving means may be spatially located on laterally opposite sides of the home plate simulation. The breakaway means are located intermediate the rear foot holding means and the mat to allow a batter's foot to breakaway from the mat when subjected to a twisting torque or similar other force resulting from a batter's bodily movement during a bat swing, the breakaway means being reattachable to the mat for repeated use.

Accordingly, although the invention has been described by reference to a preferred embodiment and several described alternative embodiments, it is not intended that the novel assembly be limited thereby, but that modifications thereof are intended to be included as falling within the broad scope and spirit of the foregoing disclosure, the following claims and the appended drawings.

I claim:

1. A baseball training system for improving a user's batting stance, the baseball training system comprising, in combination:

a baseball field, the baseball field comprising a substantially planar home plate region, a left field foul line, and a right field foul line, the home plate region comprising a left batter box, a right batter box, and a catcher box, the catcher box comprising a home plate, the home plate comprising a forward plate edge and a plate apex, the plate apex being defined by the intersection of the left and right field foul lines;

a substantially planar stance training mat, the stance training mat for placement upon the home plate region, the stance training mat comprising a superior mat surface, an inferior mat surface, and at least three zones, the zones comprising a left mat zone, a right mat zone, and a home plate zone, the left and right mat zones being aligned laterally opposite the home plate zone, the home plate zone comprising home plate marker means, the home plate marker means comprising a forward marker edge and a marker apex, the home plate marker means for placement upon the home plate, the marker apex substantially coinciding with the home plate apex and the forward marker edge substantially coinciding with the forward plate edge, the left and right mat zones each comprising a plurality of foot outlines and a plurality of tab-receiving apertures the inferior mat surface and the foot outlines comprising anti-skid means, the foot outlines comprising a series of substantially parallel forward foot markers and a series of substantially parallel rearward foot markers, the forward and rearward foot markers each being substantially parallel with the forward marker edge, each rearward foot marker comprising an anterior foot region, a posterior foot region, a metatarsal foot region, a medial foot region, and a lateral foot region, the metatarsal region extending intermediate the anterior and posterior foot regions, a set of four tab-receiving apertures being cooperatively associated with each rearward foot marker and defined by two forward apertures and two rearward apertures on opposing sides of the rearward foot marker, the tab-receiving apertures extending from the superior mat surface to the inferior mat surface adjacent the metatarsal regions; and at least one rearward foot-receiving cuff, the foot-receiving cuff comprising superior foot-positioning means and four retention tabs for breakaway engagement with a select set of tab-receiving apertures, the four retention tabs being defined by two forward tabs and two rearward tabs on opposing sides of the foot-receiving cuff, the retention tabs each comprising a substantially planar tab stop and a tab shaft removably received through the tab-receiving apertures, the tab shafts being substantially orthogonal to the stance training mat and the tab stops being substantially parallel with the stance training mat when inserted through the tab-receiving apertures, the retention tabs and the select set of tab-receiving apertures enabling forced breakaway from the stance training mat, the forward foot markers, the rearward foot markers and the foot-receiving cuff together being cooperable for selectively aligning the user's feet, the baseball training system thus used for improving the user's batting stance.

2. The baseball training system of claim 1 wherein the stance training mat is formed from a compliant, low memory material thus enabling a user to roll the stance training mat for storage or transport.

3. The baseball training system of claim 2 wherein the stance training mat is formed from a substantially transparent material.

4. The baseball training system of claim 2 wherein the foot-positioning means is defined by a flap assembly, the flap assembly comprising a foot-engaging first flap and a flap-securing second flap, the first flap comprising an inferior foot-engaging surface and a superior second flap-engaging surface, the second flap comprising an inferior first flap-engaging surface, the superior second flap-engaging surface and the inferior first flap-engaging surface each comprising matable fastening means, the inferior foot-engaging surface far receiving the rearward foot, the matable fastening means for removably securing the second flap to the first flap.

5. The baseball training system of claim 4 wherein the home plate marker means is defined by a removable home plate pattern, the removable home plate pattern enabling a user to selectively form a home plate aperture.

6. The baseball training system of claim 5 wherein the home plate aperture exposes a select home plate pattern, the select home plate pattern being selected from the group consisting of a home plate-receiving pattern and a tee-ball assembly-receiving pattern.

7. The baseball training system of claim 6 wherein the system comprises a tee-ball assembly, the tee-ball assembly comprising a tee-ball stand, the tee-ball stand being cooperatively associated with a select home plate structure, the select home plate structure being selected from the group consisting of the home plate marker means and the select home plate pattern.

8. The baseball training system of claim 1 wherein the left and right mat zones are removably attached to the home plate zone, the left and right mat zones enabling a user to selectively remove a select batting zone from the home plate zone, the select batting zone being selected from the group consisting of the left mat zone and the right mat zone.

9. The baseball training system of claim 1 wherein the superior mat surface comprises indicia means, the indicia means visually outlining at least two of the zones.

10. A baseball training assembly for improving a user's batting stance, the baseball training assembly comprising:

a substantially planar stance training mat, the stance training mat for use in combination with a baseball field, the baseball field comprising a substantially planar home plate region, a left field foul line, and a right field foul line, the home plate region comprising a left batter box, a right batter box, and a catcher box, the catcher box comprising a home plate, the home plate comprising a forward plate edge and a plate apex, the plate apex being defined by the intersection of the left and right field foul lines, the stance training mat for placement upon the home plate region, the stance training mat comprising a superior mat surface, an inferior mat surface, and at least two zones, the zones comprising a home plate zone and a select batting zone, the select batting zone being selected from the group consisting of a left mat zone and a right mat zone, the select batting zone being aligned adjacent the home plate zone, the home plate zone comprising home plate marker means, the home plate marker means comprising a forward marker edge and a marker apex, the home plate marker means for placement upon the home plate, the marker apex substantially coinciding with the home plate apex and the forward marker edge substantially coinciding with the forward plate edge, the select batting zone comprising a plurality of foot outlines and a plurality of tab-receiving apertures, the foot outlines comprising at least one forward foot marker and at least one rearward foot marker the forward and rearward foot markers each being substantially parallel with the forward marker edge, the rearward foot marker comprising an anterior foot region, a posterior foot region, a metatarsal foot region, a medial foot region, and a lateral foot region, the metatarsal region extending intermediate the anterior and posterior foot regions, a set of four tab-receiving apertures being cooperatively associated with the rearward foot marker and defined by two forward apertures and two rearward apertures on opposing sides of the rearward foot marker, the tab-receiving apertures extending from the superior mat surface to the inferior mat surface adjacent the metatarsal region; and at least one rearward foot-receiving cuff, the foot-receiving cuff comprising superior foot-positioning means and four retention tabs for breakaway engagement with the tab-receiving apertures, the four retention tabs being defined by two forward tabs and two rearward tabs on opposing sides of the foot-receiving cuff, the retention tabs each comprising a substantially planar tab stop and a tab shaft removably received through the tab-receiving apertures, the tab shafts being substantially orthogonal to the stance training mat and the tab stops being substantially parallel with the stance training mat when inserted through the tab-receiving apertures, the retention tabs and the tab-receiving apertures enabling forced breakaway from the stance training mat, the forward foot marker, the rearward foot marker and the foot-receiving cuff together being cooperable for aligning the user's feet, the baseball training assembly thus used for improving the user's batting stance.

11. The baseball training assembly of claim 10 wherein the stance training mat is fanned from a compliant, low memory material thus enabling the user to roll die stance training mat for storage or transport.

12. The baseball training assembly of claim 10 wherein the stance training mat is formed from a substantially transparent material.

13. The baseball training assembly of claim 11 wherein the inferior mat surface and the foot outlines comprise anti-skid means.

14. The baseball training assembly of claim 10 wherein the foot-positioning means is defined by a flap assembly, the flap assembly comprising a foot-engaging first flap and a flap-securing second flap, the first flap comprising an inferior foot-engaging surface and a superior second flap-engaging surface, the second flap comprising an inferior first flap-engaging surface, the superior second flap-engaging surface and the inferior first flap-engaging surface each comprising removable fastening means, the inferior foot-engaging surface for receiving the rearward foot, the removable fastening means for removably securing the second flap to the first flap.

15. The baseball training assembly of claim 10 wherein the superior mat surface comprises indicia means, the indicia means visually outlining at least two of the zones.

16. The baseball training assembly of claim 10 wherein the home plate marker means is defined by a removable home plate pattern, the removable home plate pattern enabling a user to selectively expose a home plate aperture.

17. The baseball training assembly of claim 16 wherein the home plate aperture exposes a select home plate pattern, the select home plate pattern being selected from the group consisting of a home plate-receiving pattern and a tee-ball assembly-receiving pattern.

18. The baseball training assembly of claim 17 wherein the assembly comprises a tee-ball assembly, the tee-ball assembly comprising a tee-ball stand, the tee-ball stand being cooperatively associated with a select home plate structure, the select home plate structure being selected from the group consisting of the home plate marker means and the select home plate pattern.

19. A baseball training kit for outfitting a playing field and improving a user's batting stance, the baseball training kit comprising:

a stance training mat, the stance training mat comprising a superior mat surface, an inferior mat surface, and at least two zones, the zones comprising a home plate zone and a select mat zone, the select mat zone being selected from the group consisting of a left mat zone and a right mat zone, the select mat zone being aligned adjacent the home plate zone, the home plate zone comprising home plate marker means, the home plate marker means comprising a forward marker edge and a marker apex, the select batting zone comprising a plurality of foot outlines and a plurality of tab-receiving apertures, the foot outlines comprising at least one forward foot marker and at least one rearward foot marker, the rearward foot marker being substantially parallel with the forward marker edge and comprising an anterior foot region, a posterior foot region, a metatarsal foot region, a medial foot region, and a lateral foot region, the metatarsal region extending intermediate the anterior and posterior foot regions, a set of four tab-receiving apertures being cooperatively associated with the rearward foot marker and defined by two forward apertures and two rearward apertures on opposing sides of the rearward foot marker, the tab-receiving apertures extending from the superior mat surface to the inferior mat surface adjacent the metatarsal region; and at least one rearward foot-receiving cuff, the foot-receiving cuff comprising superior foot-positioning means and four retention tabs for breakaway engagement with the tab-receiving apertures, the four retention tabs being defined by two forward tabs and two rearward tabs on opposing sides of the foot-receiving cuff, the retention tabs each comprising a substantially planar tab stop and a tab shaft removably received through the tab-receiving apertures, the tab shafts being substantially orthogonal to the stance training mat and the tab stops being substantially parallel with the stance training mat when inserted through the tab-receiving apertures, the retention tabs and the select set of tab-receiving apertures enabling forced breakaway from the stance training mat, the forward foot marker, the rearward foot marker and the foot-receiving cuff together being cooperable for aligning the user's feet, the baseball training kit thus for outfitting a playing field and improving the user's batting stance.

20. The baseball training kit of claim 19 wherein the stance training mat is formed from a compliant, low memory material thus enabling the user to roll the stance training mat for storage or transport.

21. The baseball training kit of claim 20 wherein the stance training mat is formed from a substantially transparent material.

22. The baseball training kit of claim 19 wherein the inferior mat surface and the foot outlines comprise anti-skid means.

23. The baseball training kit of claim 19 wherein the superior mat surface comprises indicia means, the indicia means visually outlining at least two of the zones.

24. The baseball training kit of claim 19 wherein the home plate marker means is defined by a removable home plate pattern, the removable home plate pattern enabling a user to selectively expose a home plate aperture.

25. The baseball training kit of claim 24 wherein the home plate aperture exposes a select home plate pattern, the select home plate pattern being selected from the group consisting of a home plate-receiving pattern and a tee-ball assembly-receiving pattern.

26. The baseball training kit of claim 25 wherein the kit comprises a tee-ball assembly, the tee-ball assembly comprising a tee-ball stand, the tee-ball stand for cooperative association with a select home plate structure, the select home plate structure being selected from the group consisting of the home plate marker means and the select home plate pattern.

27. The baseball training kit of claim 19 wherein the kit comprises a baseball bat, the baseball bat being of user-selected length.

28. A baseball training assembly for improving a user's batting stance, the baseball training assembly comprising:

a stance training mat, the stance training mat comprising a superior mat surface, an inferior mat surface, and at least two zones, the zones comprising a home plate zone and a select batting box, the select batting box being selected from the group consisting of a left mat zone and a right mat zone, the select batting box being aligned adjacent the home plate zone, the home plate zone comprising home plate marker means, the home plate marker means comprising a forward marker edge and a marker apex, the home plate marker means thus forming a virtual home plate, the select batting box comprising a plurality of foot outlines and a plurality of tab-receiving apertures, the foot outlines comprising at least one forward foot marker and at least one rearward foot marker, the rearward foot marker being substantially parallel with the forward marker edge and comprising an anterior foot region, a posterior foot region, a metatarsal foot region, a medial foot region, and a lateral foot region, the metatarsal region extending intermediate the anterior and posterior foot regions, a set of four tab-receiving apertures being cooperatively associated with the rearward foot marker and defined by two forward apertures and two rearward apertures on opposing sides of the rearward foot marker, the tab-receiving apertures extending from the superior mat surface to the inferior mat surface adjacent the metatarsal region; and rearward foot receiving means, the rearward foot-receiving means comprising superior foot-positioning means and four retention tabs for breakaway engagement with the tab-receiving apertures, the four retention tabs being defined by two forward tabs and two rearward tabs on opposing sides of the foot-receiving cuff, the retention tabs each comprising a substantially planar tab stop and a tab shaft removably received through the tab-receiving apertures, the tab shafts being substantially orthogonal to the stance training mat and the tab stops being substantially parallel with the stance training mat when inserted through the tab-receiving apertures, the retention tabs and the select set of tab-receiving apertures enabling forced breakaway from the stance training mat, the forward foot marker, the rearward foot marker and the foot-receiving means together being cooperable for aligning the user's feet, the baseball training assembly thus used for improving the user's batting stance.

29. The baseball training assembly of claim 28 wherein the inferior mat surface and the foot outlines comprise anti-skid means.

30. The baseball training assembly of claim 28 wherein the rearward foot-receiving means is defined by a foot-receiving cuff and the foot-positioning means is defined by a flap assembly, the flap assembly comprising a foot-engaging first flap and a flap-securing second flap, the first flap comprising an inferior foot-engaging surface and a superior second flap-engaging surface, the second flap comprising an inferior first flap-engaging surface, the superior second flap-engaging surface and the inferior first flap-engaging surface each comprising removable fastening means, the inferior foot-engaging surface for receiving the rearward foot, the removable fastening means for removably securing the second flap to the first flap.

31. The baseball training assembly of claim 28 wherein the home plate marker means is defined by a removable home plate pattern, the removable home plate pattern enabling a user to selectively expose a home plate aperture.

32. The baseball training assembly of claim 31 wherein the home plate aperture exposes a select home plate pattern, the select home plate pattern being selected from the group consisting of a home plate-receiving pattern and a tee-ball assembly-receiving pattern.

33. The baseball training assembly of claim 32 wherein the assembly comprises a tee-ball assembly, the tee-ball assembly comprising a tee-ball stand, the tee-ball stand for cooperative association with a select home plate structure, the select home plate structure being selected from the group consisting of the home plate marker means and the select home plate pattern.

* * * * *